US007758373B2

(12) United States Patent
Zhou et al.

(10) Patent No.: US 7,758,373 B2
(45) Date of Patent: Jul. 20, 2010

(54) CABLE ASSEMBLY WITH CONDUCTIVE WIRES NEATLY ARRANGED THEREIN

(75) Inventors: Yi Zhou, ShenZhen (CN); Xue-Nian Wang, ShenZhen (CN); Xian-Kui Shi, ShenZhen (CN); Chung-Yen Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/381,798

(22) Filed: Mar. 17, 2009

(65) Prior Publication Data

US 2009/0233487 A1 Sep. 17, 2009

(30) Foreign Application Priority Data

Mar. 17, 2008 (CN) ..... 2008 1 0019953

(51) Int. Cl.
*H01R 3/00* (2006.01)

(52) U.S. Cl. ..... 439/490; 439/620.22; 439/455

(58) Field of Classification Search ..... 439/490, 439/76.1, 620.22, 731, 455
See application file for complete search history.

(56) References Cited

U.S. PATENT DOCUMENTS

| | | | | |
|---|---|---|---|---|
| 6,572,402 | B2 * | 6/2003 | Lin | 439/490 |
| 6,705,901 | B1 * | 3/2004 | Lin | 439/668 |
| 7,396,251 | B2 * | 7/2008 | Kuo | 439/447 |
| 2004/0235338 | A1 * | 11/2004 | Lee | 439/490 |
| 2008/0003867 | A1 * | 1/2008 | Wu | 439/490 |

* cited by examiner

*Primary Examiner*—Hien Vu
(74) *Attorney, Agent, or Firm*—Wei Te Chung; Andrew C. Cheng; Ming Chieh Chang

(57) ABSTRACT

A cable assembly (100) comprises a mating member (4), a print circuit board (2), an LED (3) attached to the print circuit board (2) and a cable (6) having a positive wire (61) and a negative wire (62) connected with the mating member (4). Said positive wire and negative wire are placed on one surface of the print circuit board (2), with the LED (3) set on another surface, the positive wire and negative wire each respectively has a inner conductor (611, 621) soldered to a corresponding soldering pad on the one surface of the print circuit board, conductive traces (220, 221) are defined on the other surface of the print circuit board and connected with the LED, the soldering pads electrically connects with corresponding conductive traces by vias (210, 211) through the print circuit board.

10 Claims, 6 Drawing Sheets

CABLE ASSEMBLY WITH CONDUCTIVE WIRES NEATLY ARRANGED THEREIN

BACKGROUND OF THE INVENTION

1. Field of the Invention

The present invention generally relates to a cable assembly, and more particularly to a cable assembly with conductive wires neatly arranged therein.

2. Description of Related Art

Nowadays, cable assemblies are widely used in an electronic equipment, especially for transmitting power, and the performance of the cable assembly directly impacts on the entire electronic equipment whether can normally run.

CN Patent No. 2376104Y issued to Ye on Apr. 26, 2000 discloses a cable assembly with an LED thereon to indicate the work status thereof whether the power is on or not. Typically, the cable assembly has an insulative housing, a print circuit board received in the housing, an LED soldered to the print circuit board, a plurality of contacts connected with the print circuit board and the LED, and a plurality of cables soldered to the print circuit board. As the cable assembly mated with the complementary connector, the LED is illuminated to indicate the power is on therebetween. However, the LED, the contacts and the cables are soldered on the same side of the print circuit board, arrangement of above described is too close and is more likely to attribute a short circuit therebetween. Furthermore, it's difficult to dispose cables and weld before-mentioned electrical elements.

Hence, it is desirable to have an improved structure to overcome the above-mentioned disadvantages of the prior art.

BRIEF SUMMARY OF THE INVENTION

Accordingly, the object of the present invention is to provide a cable assembly with improved disposal of cables, LED and print circuit board, for suppressing short circuit and giving facilities for cabling.

In order to achieve the above-mentioned object, a cable assembly in accordance with the present invention comprises a mating member, a print circuit board, an LED attached to the print circuit board and a cable having a positive wire and a negative wire connected with the mating member. Said positive wire and negative wire are placed on one surface of the print circuit board, with the LED set on other surface, the positive wire and negative wire each respectively has a inner conductor soldered to a corresponding soldering pad on the one surface of the print circuit board, conductive traces are defined on the other surface of the print circuit board and connected with the LED, the soldering pads electrically connects with corresponding conductive traces by vias penetrating the print circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
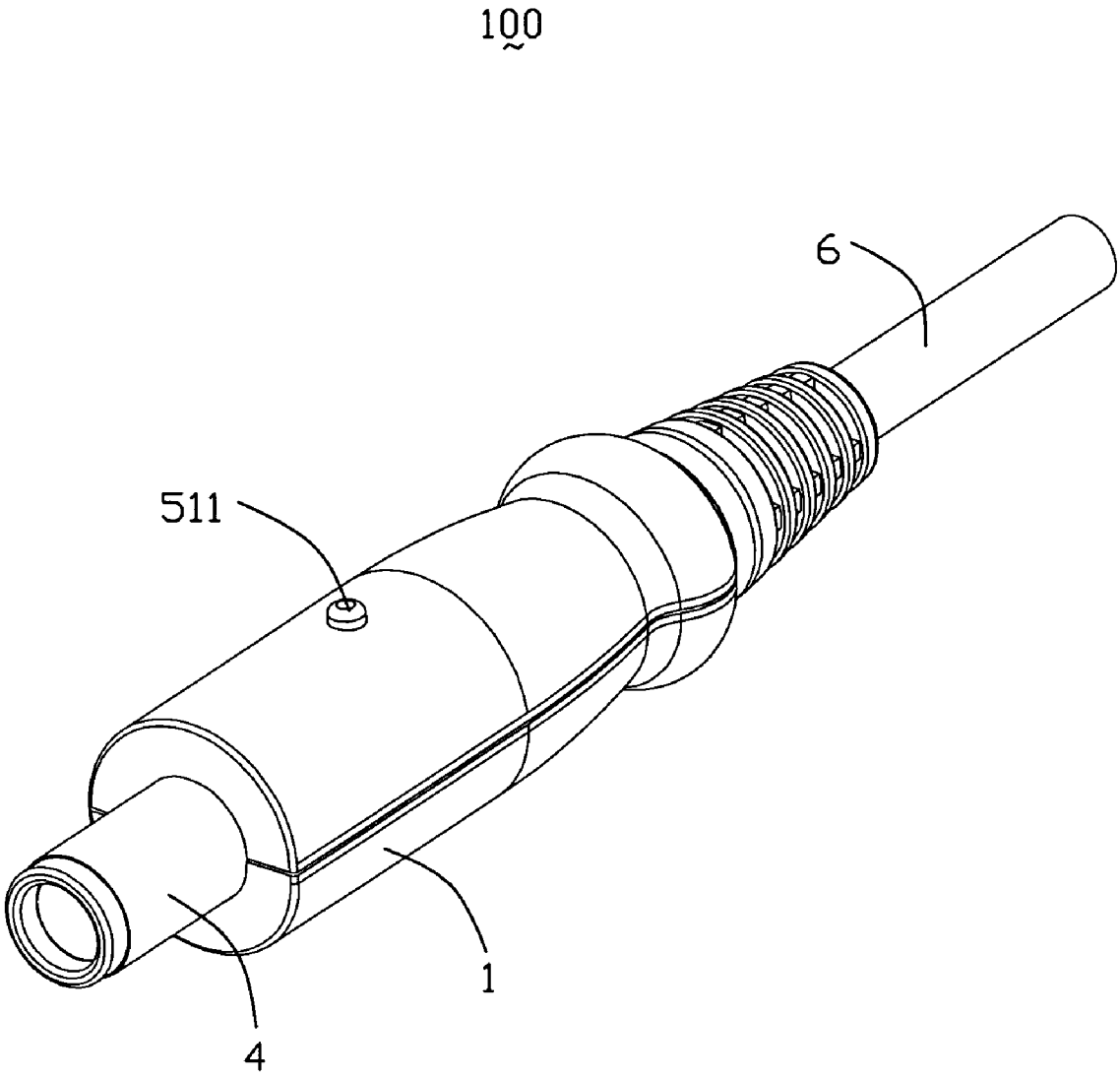
FIG. 1 is an assembled view of a cable assembly in accordance with the present invention.

Reference will now be made to the drawing figures to describe the present invention in detail.

Figure 2:
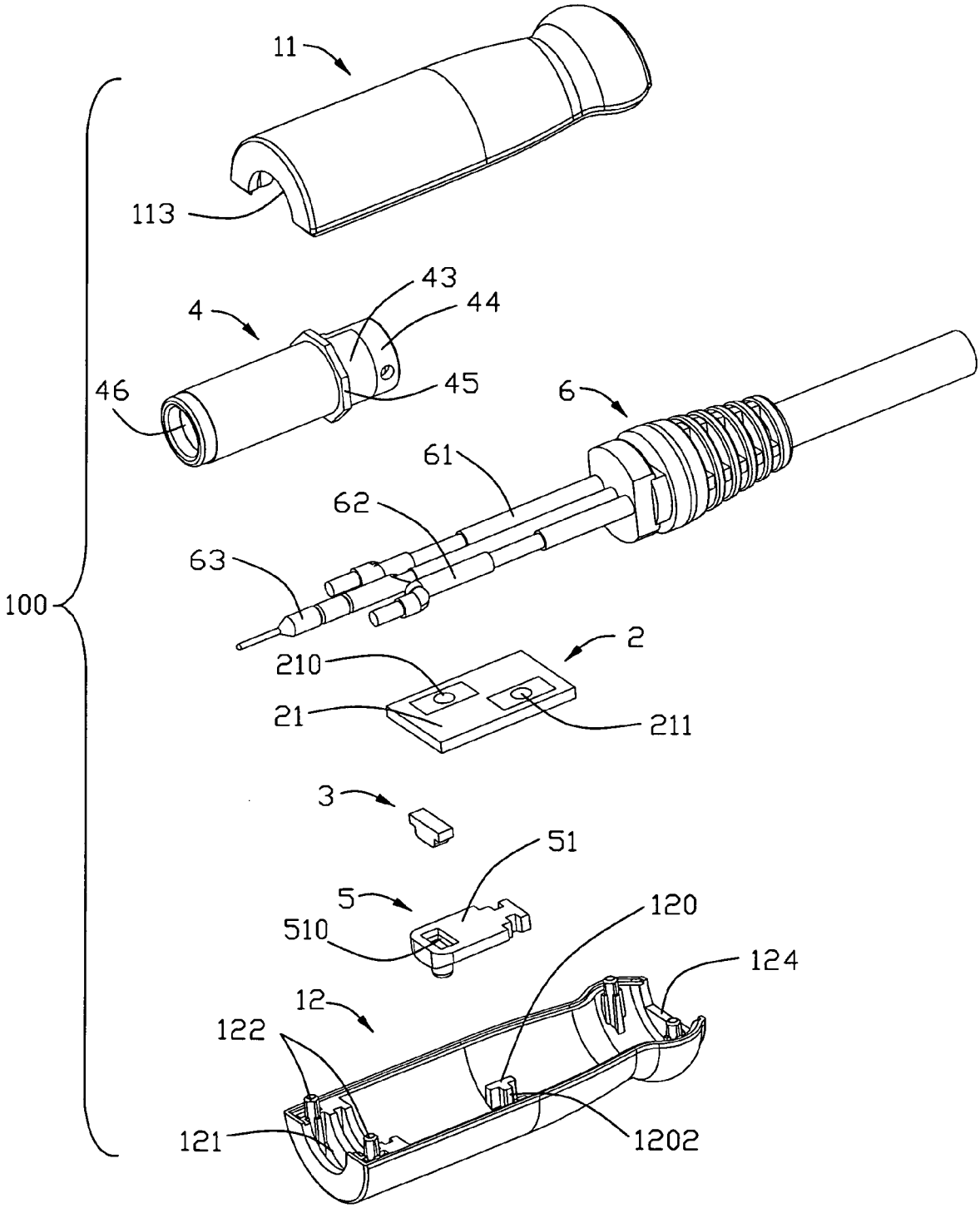
FIG. 2 is an exploded view of the cable assembly.
Figure 3:
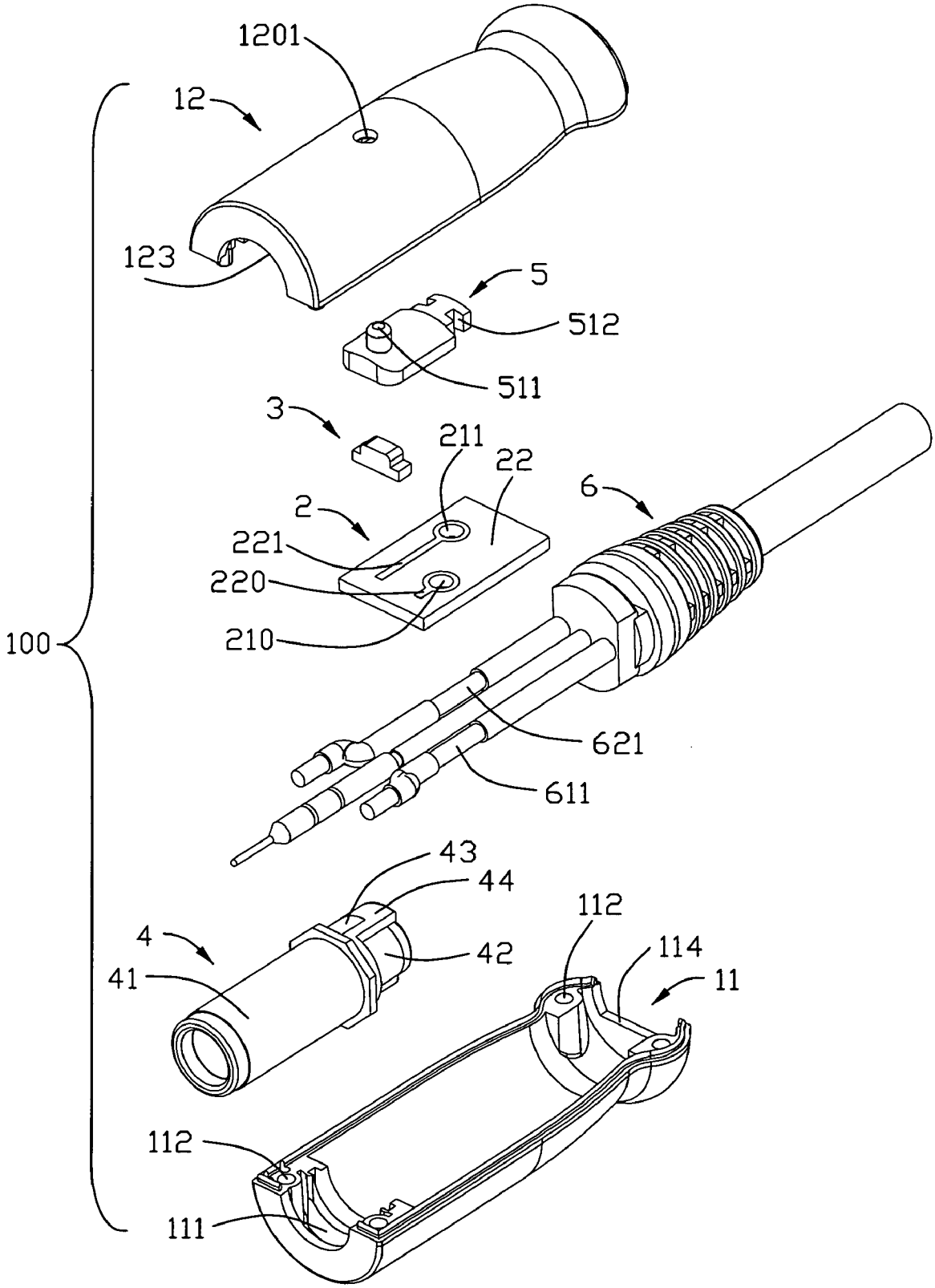
FIG. 3 is a view similar to FIG. 2, but viewed from a different angle.
Figure 4:
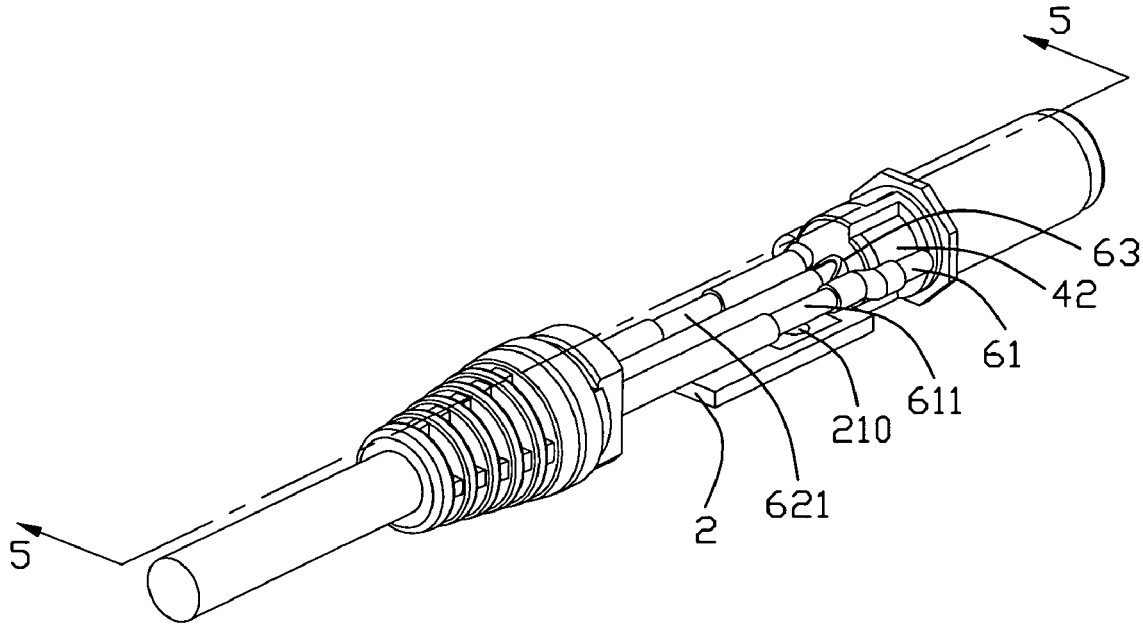
FIG. 4 is a partially assembled view of FIG. 2.
Figure 5:
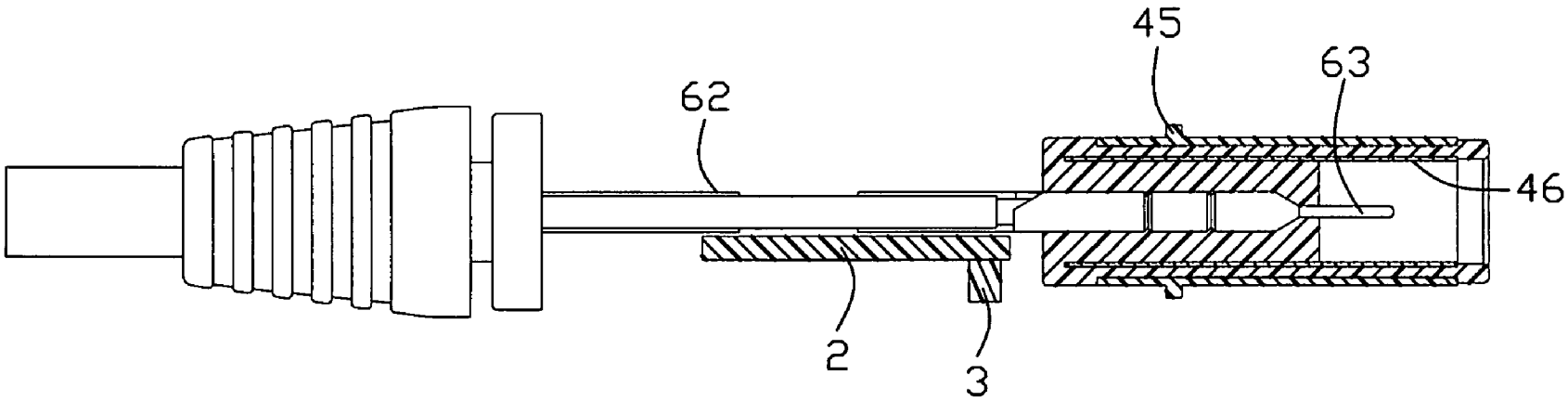
FIG. 5 is a cross-section view taken along line 5-5 of FIG. 4.
Figure 6:
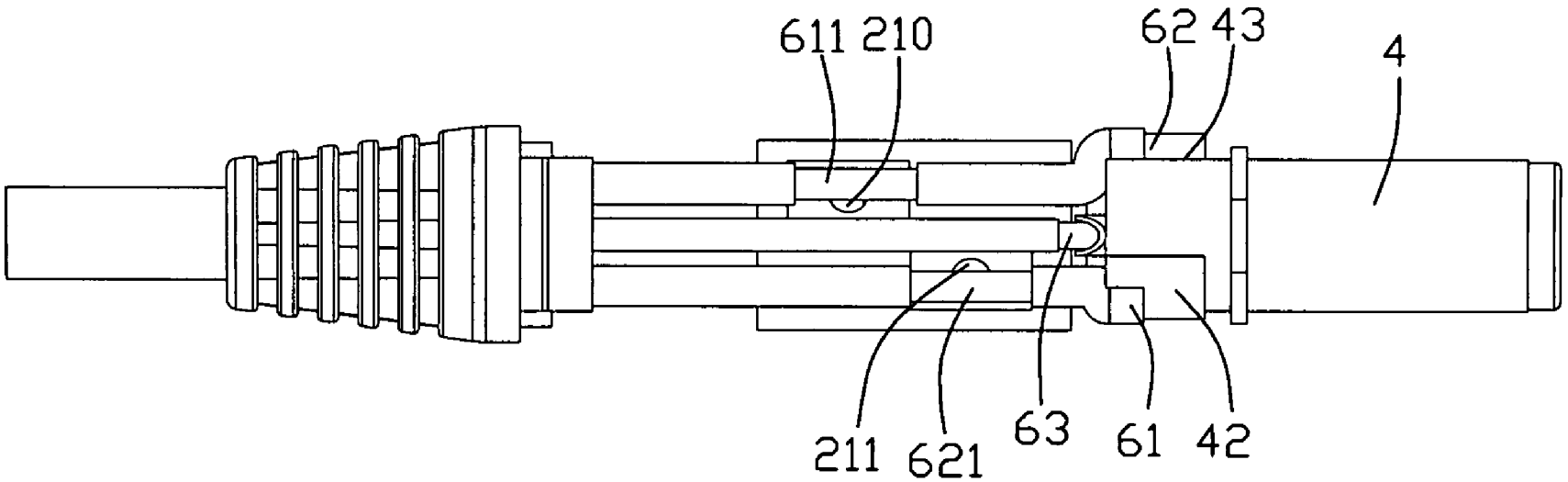
FIG. 6 is a top view of FIG. 4.

Referring to FIGS. 1-3, a cable assembly 100 made in accordance with the present invention comprises a cylindrical mating member 4, a print circuit board 2, a Light Emitting Diode (LED) 3 assembled to the print circuit board 2, a supporter 5 made of transparent material receiving the LED 3, a cable 6 with positive wire 61 and negative wire 62, and an insulative shell 1 enclosing to the components mentioned formerly.

The insulative shell 1 has a hollowed configuration with a cylindrical shape, and is configured with a top shell 11 and a bottom shell 12. The top shell 11 defines a first cambered groove 111 recessed upwards, a first semicircular hole 113 at front end thereof, and a first cutout 114. A pair of holes 112 is defined in lateral sides of front portion of the top shell 11. The bottom shell 12 is symmetrical to the top shell 11 in shape, and comprises a pair of block portions 120 in the depressed area thereof with a ridge 1202. Additionally, a through hole 1201 is defined on the outer periphery of the bottom shell 12 and locates adjacent to the block portions 120, the through hole 1201 extends through the bottom shell 12 along up-to-down direction. The bottom shell 12 defines a second cambered groove 121 in front-end corresponding to the first cambered groove 111, and a second semicircular hole 123 together with the first semicircular hole 113 to form a circular hole. Furthermore, the bottom shell 12 also has a second cutout 124 matching with the first cutout 114, and a plurality of posts 122 received in the corresponding holes 112.

The print circuit board 2 is configured in rectangular structure, and it defines an upper surface 21 and a lower surface 22, a pair of soldering pads are arranged on the upper surface 21 in diagonal and staggered relationship, conductive vias 210, 211 are respectively defined in the corresponding soldering pad. The conductive vias 210, 211 are not in a line along a direction perpendicular to a mating portion, and the conductive via 210 is closer to the front edge of the print circuit board 2 than the conductive via 211. The lower surface 22 has conductive traces 220, 221 connected to the conductive vias 210, 211 and extended forwards. The LED 3 has a convex top, and disposed on the print circuit board 2 to form a unitary configuration by surface mount technique (SMT), such that the LED 3 sticks to front part of the lower surface 22 of the print circuit board 2, and electrically connects with the conductive traces 220, 221.

The supporter 5 has a flat base portion 51 with a depression 510 recessed downwards on the front end thereof for receiving the LED 3 therein. A transparent column 511 functioning as a light pipe, is protruding out of the bottom of the supporter 5 and aligning with the depression 510. Additionally, the supporter 5 defines an I-shape extension portion 512 in a back end thereof to cooperate with the block portion 120 of the bottom shell 12.

The cable 6 comprises a strain relief (not numbered) for stress release, a positive wire 61 and a negative wire 62 extending forwardly beyond the strain relief, and a middle wire (not numbered) connecting a detective contact 63 located between the positive wire 61 and negative wire 62. The positive wire 61 and negative wire 62 each respectively has inner conductors 611, 621 with part of the corresponding outer jacket stripped away to a certain length from front end thereof to expose part thereof. The inner conductors 611, 621 that exposed outside are offset from each other. The inner conductors 611, 621 are arranged respectively corresponding to the conductive vias 210, 211.

The cylindrical mating member 4 comprises a hollowed mating section 41 in the front end, a polygonal flange 45 surrounding the cylindrical mating member 4, a positive tube 42 located behind the polygonal flange 45 and communicated with a inner wall 46 of the cylindrical mating member 4, and a negative tube 43 located behind the polygonal flange 45 and isolated from the positive tube 42 by plastic layer 44. The negative tube 43 is communicated with outer wall of the mating section 41 and has the same polarity with each other. However, in other alternative embodiment, the positive tube 42 and the inner wall 46 may be integrally formed of one single piece structure, so do the negative tube 43 and the outer wall of the mating section 41.

In assembly, the inner conductor 611, 621 of the positive wire 61 and the negative wire 62 are respectively soldered to the conductive vias 210, 211 on the upper surface 21, the LED 3 is attached to the lower surface 22 of the print circuit board 2 and electrically connected with the conductive vias 210, 211. As the inner conductors 611, 621 are respectively soldered to the conductive vias 210, 211 on the soldering pads, the soldering pads are connected with the inner conductor 611, 621 by the conductive vias 210, 211, finally, the positive wire 61 and the negative wire 62 are connected with the LED 3 via the soldering pads, the conductive vias 210, 211, and the conductive traces 220, 221. Then, the LED 3 is received in the depression 510 of the supporter 5 as an indicator.

Then, cylindrical mating member 4 is electrically connected with the cable 6, the front end of the positive wire 61 is soldered to the positive tube 42, the negative wire 62 is soldered to the negative tube 43 with front end, the detective contact 63 extends through an aperture (not shown) in the back end of the cylindrical mating member 4 and enters into the cavity of the cylindrical mating member 4. Finally, the top shell 11 is assembled to the bottom shell 12, the supporter 5 is mounted to the block portions 120 with the I-shape extended portion 512 sliding along the ridge 1202 of the bottom shell 12, and the transparent column 511 is received in the through hole 1201 to indicate the work status of the cable assembly 100. The first cambered groove 111 of the top shell 11 cooperates with the second cambered groove 121 of the bottom shell 12 to receive the polygonal flange 45. The posts 122 of the bottom shell 12 are respectively received in the relevant notches 112, the first cutout 114 of the top shell 11 is cooperated with the second cutout 124 of the bottom shell 12 to receive the front part of the strain relief member of the cable 6. Thus, the cable assembly 100 is assembled.

In accordance with the embodiment of the present invention, the LED 3 is soldered on one surface 21 as the positive wire 61 and the negative wire 62 soldered on another surface 22 of the print circuit board 2, therefore, it's easy to arrange the wiring and soldering, simultaneously, the soldering pad, the conductive vias 210, 211 and the inner conductors 611, 621 are in staggered relationship relative to each other to avoid short circuit. Besides, when the positive wire 61 and negative wire 62 are soldered in the conductive vias 210, 211, solder material will flow down from the conductive vias 210, 211 so as to ensure a stronger soldering joint between the cable 6 with the print circuit board 2. In other alternative embodiment, the conductive vias 210, 211 is insulative, when the positive wire 61 and negative wire 62 are soldered in the conductive vias 210, 211, solder mass will flow down to form electrical connection between the soldering pad and the conductive traces 220, 221.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a mating member having an inner wall;

a print circuit board;

an LED attached to the print circuit board;

a cable having a positive wire and a negative wire connected with the mating member; and said positive wire and negative wire placed on one surface of the print circuit board, with the LED set on other surface, the positive wire and negative wire each respectively having a inner conductor soldered to a corresponding soldering pad on the one surface of the print circuit board, conductive traces defined on the other surface of the print circuit board and connected with the LED, the soldering pads electrically connected with corresponding conductive traces by vias through the print circuit board;

wherein partial of outer jackets of the power and negative wire are stripped away to expose corresponding inner conductors outside, the corresponding inner conductors are offset from each other and respectively placed adjacent the conductive vias;

wherein the cable assembly further comprising a supporter, the supporter defines a depression receiving the LED, an extension portion having grooves in a back end thereof to cooperate with a block portion of a bottom shell, and a transparent column extended outwardly;

wherein the cable assembly further comprising an insulative shell, which comprises a top shell and the bottom shell, a through hole receiving the transparent column is defined in one of the top shell and bottom shell; and wherein the mating member is of cylindrical shape and has a flange received in cambered grooves of the top and bottom shells.

2. The cable assembly as claimed in claim 1, wherein one of vias is closer to front end of the print circuit board than another.

3. The cable assembly as claimed in claim 2, wherein said vias are defined in corresponding soldering pad and in stagger relationship relative to each other.

4. The cable assembly as claimed in claim 3, wherein the LED is mounted to the print circuit board by surface mount technique.

5. The cable assembly as claimed in claim 4, wherein said inner conductors are soldered in the corresponding vias and electrically connected with the conductive traces to connect with the LED.

6. The cable assembly as claimed in claim 1, wherein a block portion is defined on one of the top shell and bottom shell, to retain the supporter.

7. The cable assembly as claimed in claim 1, wherein the transparent column extends through the through hole.

8. A cable assembly, comprising:

a mating connector including a cylindrical housing defining a receiving cavity therein;

a detective pin extending into the receiving cavity, and a power collar disposed on a rear portion of the housing;

a wire interconnected to the detective pin, and a pair of power conductive wires interconnected to the power collar and each interconnected to a substrate on which soldering pads are provided, an indicator interconnected to the substrate;

wherein the soldering pads are arranged on one surface of the substrate, and a plurality of conductive traces are displaced on another surface;

wherein the power conductive wires each respectively has inner conductors with part of the corresponding outer jacket stripped away to expose part thereof, the inner conductors of cable aligned with the soldering pad and soldered in the vias;

wherein the cable assembly further comprising a supporter, the supporter defines a depression receiving the LED, an extension portion having grooves in a back end thereof to cooperate with a block portion of a bottom shell, and a transparent column extended outwardly; and wherein the cable assembly further comprising an insulative shell, which comprises a top shell and the bottom shell, a through hole receiving the transparent column is defined in one of the top shell and bottom shell.

9. The cable assembly of claim 8, wherein the soldering pad in stagger relationship relative to each other.

10. The cable assembly of claim 9, wherein a plurality of vias are defined to through the soldering pad of the substrate and connected with conductive traces, the indicator attached on the same surface of the substrate as the conductive traces and connected with the conductive traces.

* * * * *